US010876065B2

(12) United States Patent
Saito et al.

(10) Patent No.: US 10,876,065 B2
(45) Date of Patent: Dec. 29, 2020

(54) GREASE COMPOSITION

(71) Applicant: KYODO YUSHI CO., LTD., Fujisawa (JP)

(72) Inventors: Ryosuke Saito, Chigasaki (JP); Yuta Sato, Fujisawa (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 15/505,382

(22) PCT Filed: Aug. 31, 2015

(86) PCT No.: PCT/JP2015/074601
§ 371 (c)(1),
(2) Date: Feb. 21, 2017

(87) PCT Pub. No.: WO2016/031998
PCT Pub. Date: Mar. 3, 2016

(65) Prior Publication Data

US 2017/0275558 A1 Sep. 28, 2017

(30) Foreign Application Priority Data

Aug. 29, 2014 (JP) ..... 2014-175352

(51) Int. Cl.

| | |
|---|---|
| ***C10M 169/06*** | (2006.01) |
| ***C10M 159/06*** | (2006.01) |
| ***C10N 20/02*** | (2006.01) |
| ***C10N 20/04*** | (2006.01) |
| ***C10N 30/06*** | (2006.01) |
| ***C10N 40/02*** | (2006.01) |
| ***C10N 40/04*** | (2006.01) |
| ***C10N 50/10*** | (2006.01) |
| ***C10N 60/04*** | (2006.01) |

(52) U.S. Cl.
CPC ..... *C10M 169/06* (2013.01); *C10M 159/06* (2013.01); *C10M 2203/1025* (2013.01); *C10M 2203/1065* (2013.01); *C10M 2205/022* (2013.01); *C10M 2205/024* (2013.01); *C10M 2205/14* (2013.01); *C10M 2205/16* (2013.01); *C10M 2205/18* (2013.01); *C10M 2207/0406* (2013.01); *C10M 2207/2805* (2013.01); *C10M 2207/2835* (2013.01); *C10M 2215/006* (2013.01); *C10M 2215/1026* (2013.01); *C10M 2215/28* (2013.01); *C10N 2020/02* (2013.01); *C10N 2020/04* (2013.01); *C10N 2030/06* (2013.01); *C10N 2040/02* (2013.01); *C10N 2040/04* (2013.01); *C10N 2050/10* (2013.01); *C10N 2060/04* (2013.01)

(58) Field of Classification Search
CPC ..... C10M 169/06; C10M 115/08; C10M 133/16; C10M 133/56; C10M 143/04; C10M 143/18; C10M 159/06; C10M 2203/1025; C10M 2203/1065; C10M 2205/022; C10M 2205/024; C10M 2205/14; C10M 2205/16; C10M 2205/18; C10M 2207/0406; C10M 2207/2805; C10M 2207/2835; C10M 2215/006; C10M 2215/1026; C10M 2215/28; C10N 2250/10; C10N 2020/02; C10N 2020/04; C10N 2030/06; C10N 2040/02; C10N 2040/04; C10N 2050/10; C10N 2060/04
See application file for complete search history.

(56) References Cited

U.S. PATENT DOCUMENTS

| | | | | |
|---|---|---|---|---|
| 5,043,085 | A * | 8/1991 | Kinoshita | C10M 169/06 508/316 |
| 5,081,322 | A * | 1/1992 | Winter | C08F 210/06 526/127 |
| 5,746,812 | A * | 5/1998 | Muller | C08J 3/03 106/10 |
| 6,172,013 | B1 * | 1/2001 | Holt | C10M 141/02 508/364 |
| 9,567,548 | B2 | 2/2017 | Yamazaki | |
| 2003/0069147 | A1 * | 4/2003 | Kawamura | C10M 169/00 508/555 |
| 2004/0121919 | A1 * | 6/2004 | Gao | C10M 123/04 508/363 |

(Continued)

FOREIGN PATENT DOCUMENTS

| | | | |
|---|---|---|---|
| CN | 101200669 | A | 6/2008 |
| CN | 104822811 | A | 8/2015 |

(Continued)

OTHER PUBLICATIONS

BASF, Luwax AF types Technical Information, May 2005, retrieved from the internet at <http://www2.basf.us/additives/pdfs/luwax_af_ES1188e.pdf> dated Jun. 1, 2018.*

(Continued)

*Primary Examiner* — James C Goloboy

(74) *Attorney, Agent, or Firm* — Buchanan Ingersoll & Rooney PC

(57) ABSTRACT

The invention provides a grease composition used for lubricating a mechanical part having a steel portion to be lubricated which performs a rolling motion and a rolling and sliding motion, containing a base oil, a thickener and an additive, wherein the additive includes at least one compound selected from the group consisting of polyethylene wax, oxidized polyethylene wax, polypropylene wax, montan wax and amide wax.

9 Claims, No Drawings

(56) References Cited

U.S. PATENT DOCUMENTS

| | | | | |
|---|---|---|---|---|
| 2006/0154831 | A1 | 7/2006 | Iwano | |
| 2007/0149422 | A1* | 6/2007 | Miyajima | C10M 159/06 508/451 |
| 2008/0176776 | A1* | 7/2008 | E. | C10M 169/06 508/376 |
| 2013/0157915 | A1 | 6/2013 | Azuma et al. | |
| 2015/0065404 | A1* | 3/2015 | Matsubara | C10M 169/06 508/100 |
| 2015/0247105 | A1 | 9/2015 | Yamazaki | |

FOREIGN PATENT DOCUMENTS

| | | | |
|---|---|---|---|
| EP | 3239281 | A1 | 11/2017 |
| JP | 60-31598 | A | 2/1985 |
| JP | 2-194095 | A | 7/1990 |
| JP | 2003-82374 | A | 3/2003 |
| JP | 2003-105366 | A | 4/2003 |
| JP | 2003-183687 | A | 7/2003 |
| JP | 2003-321694 | A | 11/2003 |
| JP | 2004-301268 | A | 10/2004 |
| JP | 2004-345595 | A | 12/2004 |
| JP | 2005-112955 | A | 4/2005 |
| KR | 10-2005-0022236 | A | 3/2005 |
| KR | 2005-0022236 | A | 3/2005 |
| WO | WO 2004/081156 | A1 | 9/2004 |
| WO | 2014/054797 | A1 | 4/2014 |

OTHER PUBLICATIONS

International Search Report (PCT/ISA/210) dated Sep. 16, 2015, by the Japanese Patent Office as the International Searching Authority for International Application No. PCT/JP2015/074601.

Written Opinion (PCT/ISA/237) dated Sep. 16, 2015, by the Japanese Patent Office as the International Searching Authority for International Application No. PCT/JP2015/074601.

Dong et al., "Formation of EHL Film with Grease in Ball Bearings at Low Speeds", the JAST Tribologist, 2012, pp. 568-574, vol. 57, No. 8 (with English abstract).

Endo et al., "Determination of Thickness of EHL Film with Grease at Low Speeds", Proceedings of JAST Tribology Conference, May 2008, pp. 181-182.

Dong et al., "Prolongation of anti-flaking life by urea type thickener of grease", Proceedings of JAST Tribology Conference, Nov. 2001, pp. 355-356.

Extended Search Report dated by the European Patent Office in corresponding European Patent Application No. 15834833.4-1370 dated Jan. 4, 2018 (8 pages).

The First Office Action issued by the State Intellectual Property Office of People's Republic of China in corresponding Chinese Patent Application No. 201580045862.9 dated Feb. 28, 2019 (11 pages including partial English translation).

* cited by examiner

GREASE COMPOSITION

TECHNICAL FIELD

The present invention relates to a grease composition used for lubricating the mechanical parts having steel portions to be lubricated which perform a rolling motion and a rolling and sliding motion.

BACKGROUND ART

Representative mechanical parts having steel portions to be lubricated when performing a rolling motion and a rolling and sliding motion include rolling bearings, gears, ball screws, linear motion guide bearings, joints, cams and the like.

More specifically, there are rolling bearings used for various motors of industrial machines, office machines and automobiles; automotive wheel bearings, rolling bearings used for automotive electrical equipment and automotive auxiliaries such as alternators, electromagnetic clutches, idle pulleys, timing belt tensioners and the like; speed reduction gears and speed increasing gears for windmills, robots, automobiles and the like; ball screws used for electric power steering, machine tools and the like; linear motion guide bearings used for industrial equipment, electronic equipment and the like; constant velocity joints used for drive shafts and propeller shafts of automobiles, and the like.

On the other hand, a sliding motion presents a contrast to the rolling motion and the rolling and sliding motion. The life of the parts subjected to the sliding motion is not determined by flaking, but mainly by wearing and seizing. Representative examples of the mechanical parts performing the sliding motion include journal bearings (sliding bearings), pistons, screws, ropes, chains and the like.

Recently, for the mechanical parts used in a variety of industrial fields, higher efficiency has been required from the viewpoint of reduction in consumption energy. Many trials have been continued to reduce the weight of the parts and improve the structure of the parts. Especially, in the automotive industry, the trend toward smaller size of parts has resulted in higher speed of the mechanical parts having a body of revolution, and therefore larger change of the speed during the revolution, thereby causing a rolling and sliding motion as well as the rolling motion. In addition, the load applied to the mechanical parts having the body of revolution has become larger for increasing the transmission efficiency, and the temperature in the operating environment has become higher because the operating environment is made so airtight that the heat generated in the parts cannot easily leak out. As a result, the oil film formed on the portions to be lubricated becomes thinner, which makes the metallic members directly come in contact with each other and therefore causes the problem of higher friction torque in the rolling motion and the rolling and sliding motion. Also, the thinner oil film will disadvantageously produce the problem of surface-initiated flaking on the portions to be lubricated.

To solve the problem of increasing friction torque, an instrument for determining the bearing lubrication properties was used to measure the friction torque, to find that the formation of EHL film with grease can prevent the direct contact of metallic members and the friction torque can become drastically smaller at low speeds where formation of the oil film is especially difficult when compared with the case where the metallic members are lubricated with base oil (Dong, Komoriya, Endo and Kimura, "Formation of EHL Film with Grease in Ball Bearings at Low Speeds", the JAST Tribologist 57-8 (2012) pp. 568-574).

It was found that not only the grease can form a thicker EHL film than the base oil at low speeds, but also the EHL film thickness varies depending on the kind of thickener, i.e., a grease comprising a urea type thickener can form much thicker EHL film than a grease comprising a Li soap type thickener (Endo, Dong and Kimura. "Determination of Thickness of EHL Film with Grease at Low Speeds", Proceedings of JAST Tribology Conference, Tokyo 2008-5, pp. 181-182).

With respect to the problem of the surface-initiated flaking as mentioned above, a test of evaluating the occurrence of flaking using a rolling four-ball tester showed the anti-flaking life obtained by the grease comprising a urea type thickener to be longer than that obtained by the grease comprising a Li soap type thickener (Dong, Endo and Kimura, "Prolongation of anti-flaking life by urea type thickener of grease", Proceedings of JAST Tribology Conference, Utsunomiya 2001-11, pp. 355-356).

Conventionally, the anti-flaking life of the steel parts which are subjected to the rolling motion and the rolling and sliding motion and therefore designed to be lubricated is ended by metal fatigue. Thickening the lubricating oil film is conventionally regarded as the only measure to sufficiently lengthen the anti-flaking life. Therefore, the grease used for lubricating the above-mentioned parts has been required just to create a sufficiently thick oil film, in other words, to contain a base oil with a sufficiently high viscosity. However, the above-mentioned measure has the shortcomings that high viscosity will generate more heat and increase the resistance to stirring.

When the oil film becomes thin, minute projections on the surfaces of the parts are brought into contact with each other, which readily causes the flaking originating from the surfaces, to shorten the life of the parts. The thickness of the oil film is getting closer and closer to zero when the speed of the mechanical part is zero. In fact, the state where the speed of the mechanical part is zero is frequently reached while the part is repeatedly started and stopped or the part is reciprocatively swinging.

In order to reduce the friction torque and prevent the surface-initiated flaking, it is considered that the best way of forming a sufficient oil film at low speeds, i.e., under the conditions where formation of the oil film is difficult should be key to the improvement, as stated in the above-mentioned prior-art documents.

To solve the surface-initiated flaking, use of various additives has been discussed. For example, it is proposed in JP 2003-183687 A to use oxides and carbonates of bivalent typical metals such as Ca. Zn. Pb and the like. Use of benzotriazole and/or derivatives thereof is proposed in JP 2003-82374 A. Furthermore, it is proposed in JP 2003-321694 A to use an organic sulfonate as the component for extending the anti-flaking life.

SUMMARY OF INVENTION

Technical Problem

The measures described in the prior art have just provided a way of preventing the metal surfaces from coming in direct contact with each other by forming a film of additives through the reaction or adsorption. Therefore, there is yet room for improvement in the thickness of the formed oil film itself. Further, once the reaction film or adsorption film is formed, the oil film is required not to peel off even though the operations are continued, and to stand the severe operating environments of the above-mentioned mechanical parts. The grease containing a thickener, in particular, a urea type thickener can form a thick oil film. However, formation of a thicker oil film may be sometimes required depending on the operating environments.

An object of the invention is therefore to provide a grease composition that can be used for lubricating the mechanical parts having steel portions to be lubricated which perform a rolling motion and a rolling and sliding motion. In particular, the object of the invention is to provide a grease composition capable of reducing the friction torque and extending the anti-flaking life of metallic parts by forming a thicker oil film on the portions to be lubricated to prevent the metallic parts from coming in direct contact with each other.

Solution to Problem

To solve the above-mentioned problems, the inventors of the invention chose a proper additive. Namely, the present invention provides a grease composition and a mechanical part as follows.

1. A grease composition that can be used for lubricating a mechanical part having a steel portion to be lubricated which performs a rolling motion and a rolling and sliding motion, comprising a base oil, a thickener and an additive, wherein the additive comprises at least one compound selected from the group consisting of polyethylene wax, oxidized polyethylene wax, polypropylene wax, montan wax and amide wax.

2. The grease composition described in the above-mentioned item 1, wherein the at least one compound is contained in an amount of 0.1 to 10 mass % in the grease composition.

3. The grease composition described in the above-mentioned item 1 or 2, wherein the thickener is a urea type thickener.

4. The grease composition described in any one of the above-mentioned items 1 to 3, wherein the thickener is a diurea compound represented by the following formula (1):

$$\text{R1-NHCONH—R2-NHCONH—R3} \quad (1)$$

wherein R2 is a bivalent aromatic hydrocarbon group having 6 to 15 carbon atoms; and R1 and R3, which may be the same or different from each other, each represent an alkyl group having 6 to 30 carbon atoms, an aryl group having 6 or 7 carbon atoms, or cyclohexyl group.

5. A mechanical part having a steel portion to be lubricated which performs a rolling motion and a rolling and sliding motion, wherein the grease composition described in any one of the above-mentioned items 1 to 4 is enclosed.

Effects of Invention

In the mechanical part having a steel portion to be lubricated which performs a rolling motion and a rolling and sliding motion, the grease composition of the invention can form a thick oil film on the steel portion. The oil film thus formed is thick enough to prevent the metallic members from coming in direct contact with each other, so that the friction torque can be reduced and the anti-flaking life can be extended.

DESCRIPTION OF EMBODIMENTS

<Base Oil>

The base oil that can be used in the invention is not particularly limited. Any base oils including mineral oils can be used. One kind of base oil may be used alone or two or more base oils may be used in combination.

Examples of the mineral oils include paraffinic mineral oils, naphthenic mineral oils and mixtures thereof. In particular, the mixture of the paraffinic mineral oil and the naphthenic mineral oil is preferable.

Examples of the synthetic oils include synthetic ester oils such as diesters and polyol esters, synthetic hydrocarbon oils such as poly α-olefins and polybutene, synthetic ether oils such as alkyl diphenyl ethers and polypropylene glycols, silicone oils, fluorinated oils, and other kinds of synthetic oils. Of the above synthetic oils, it is preferable to use the synthetic hydrocarbon oil, the ester oil, the synthetic ether oil, and the mixture thereof. More preferably, the synthetic hydrocarbon oil, the ester oil and the mixture thereof may be used. Most preferably, the synthetic hydrocarbon oil and the mixture of the synthetic hydrocarbon oil and the ester oil may be used.

As the base oil, the mineral oil, the synthetic hydrocarbon oil, and the ester oil are preferable. It is more preferable to use the mixture of paraffinic mineral oil and naphthenic mineral oil, the synthetic hydrocarbon oil, and the mixture of the synthetic hydrocarbon oil and the ester oil.

The kinematic viscosity of the base oil used in the invention is not particularly limited, and may be determined if necessary. The kinematic viscosity at 40° C. may preferably be 10 to 200 $mm^2/s$, more preferably 15 to 170 $mm^2/s$, and most preferably 30 to 140 $mm^2/s$.

The content of the base oil may preferably be in the range of 50 to 95 mass %, and more preferably 60 to 90 mass %, in the grease composition of the invention.

<Thickener>

The thickener used in the grease composition of the invention is not particularly limited. Preferable examples of the thickener include soap type thickeners such as lithium soap, lithium complex soap and the like; urea type thickeners such as diurea and the like; inorganic thickeners such as organoclay, silica and the like; and organic thickeners such as polytetrafluoroethylene (PTFE) and the like. Particularly preferable is the urea type thickener.

Of the urea type thickeners, a diurea compound represented by the following formula (1) is preferable:

$$\text{R1-NHCONH—R2-NHCONH—R3} \quad (1)$$

wherein R2 is a bivalent aromatic hydrocarbon group having 6 to 15 carbon atoms; and R1 and R3, which may be the same or different from each other, each represent a saturated or unsaturated alkyl group having 6 to 30 carbon atoms, an aryl group having 6 or 7 carbon atoms, or cyclohexyl group.

When one of R1 or R3 represents cyclohexyl group, the other may preferably be a saturated or unsaturated alkyl group having 6 to 30 carbon atoms. In this case, the molar ratio of the cyclohexyl group to the alkyl group may preferably be 20:80 to 95:5, and more preferably 30:70 to 90:10.

R2 may represent tolylene diisocyanate or diphenylmethane diisocyanate, and the latter is preferable.

R1 and R3, which may be the same or different from each other, each may preferably represent a saturated or unsaturated alkyl group having 8 to 20 carbon atoms, an aryl group having 6 or 7 carbon atoms, or cyclohexyl group. The saturated alkyl group having 8 or 18 carbon atoms, the aryl group having 7 carbon atoms, or cyclohexyl group is more preferable.

A diurea compound where R2 represents tolylene diisocyanate or diphenylmethane diisocyanate in the formula (1) is preferable.

A diurea compound where R2 represents diphenylmethane diisocyanate in the formula (1) is more preferable.

A diurea compound where R2 represents diphenylmethane diisocyanate, and R1 and R3, which may be the same or different from each other, each represent a saturated or unsaturated alkyl group having 8 to 20 carbon atoms, an aryl group having 6 or 7 carbon atoms or cyclohexyl group in the formula (1) is further more preferable.

A diurea compound where R2 represents diphenylmethane diisocyanate, and R1 and R3, which may be the same or different from each other, each represent a saturated alkyl group having 8 or 18 carbon atoms, an aryl group having 7 carbon atoms or cyclohexyl group in the formula (1) is particularly preferable.

In particular, a diurea compound where R2 represents diphenylmethane diisocyanate, and R1 and R3 each represent a saturated alkyl group having 8 carbon atoms in the formula (1) is more preferable.

In particular, a diurea compound where R2 represents diphenylmethane diisocyanate, and R1 and R3, which may be the same or different from each other, each represent a saturated alkyl group having 8 or 18 carbon atoms in the formula (1) is also more preferable. It is particularly preferred to use a mixture of a diurea compound where R1 and R3 each represent a saturated alkyl group having 8 carbon atoms, a diurea compound where R1 and R3 each represent a saturated alkyl group having 18 carbon atoms, and a diurea compound where one of R1 or R3 represents a saturated alkyl group having 8 carbon atoms and the other represents a saturated alkyl group having 18 carbon atoms. In this case, the molar ratio of the saturated alkyl group having 8 carbon atoms to the saturated alkyl group having 18 carbon atoms may preferably be 10:90 to 90:10, and more preferably 30:70 to 70:30.

Also, a diurea compound where R2 represents diphenylmethane diisocyanate, and R1 and R3 each represent an aryl group having 7 carbon atoms in the formula (1) is more preferable.

Further, a diurea compound where R2 represents diphenylmethane diisocyanate, and R1 and R3, which may be the same or different from each other, each represent a saturated alkyl group having 18 carbon atoms or cyclohexyl group in the formula (1) is particularly preferable. It is particularly preferred to use a mixture of a diurea compound where R1 and R3 each represent a saturated alkyl group having 18 carbon atoms, a diurea compound where R1 and R3 each represent cyclohexyl group, and a diurea compound where one of R1 or R3 represents a saturated alkyl group having 18 carbon atoms and the other represents cyclohexyl group. In this case, the molar ratio of the cyclohexyl group to the alkyl group may preferably be 20:80 to 95:5, and more preferably 30:70 to 90:10.

The diurea compound of formula (1) is obtainable by reacting a predetermined diisocyanate with a predetermined monoamine, for example. Preferable specific examples of the diisocyanate include diphenylmethane-4,4'-diisocyanate and tolylene diisocyanate. Examples of the monoamine include aliphatic amine compounds, aromatic amine compounds, alicyclic amine compounds and the mixtures thereof. Specific examples of the aliphatic amine compounds include octylamine, nonylamine, decylamine, undecylamine, dodecylamine, tridecylamine, tetradecylamine, pentadecylamine, hexadecylamine, heptadecylamine, octadecylamine, nonyldecylamine, eicodecylamine, oleylamine and the like. Specific examples of the aromatic amine compounds include aniline, p-toluidine, naphthylamine and the like. Specific examples of the alicyclic amine compounds include cyclohexylamine, dicyclohexylamine and the like.

The content of the thickener in the grease composition of the invention varies depending upon the kind of thickener. The grease composition of the invention may preferably have a consistency of 200 to 400, and the content of the thickener is determined so as to obtain the above-mentioned consistency. The content of the thickener may generally be 3 to 30 mass %, and preferably in the range of 5 to 25 mass %, in the grease composition of the invention.

<Additive>

The additive used in the invention comprises at least one compound selected from the group consisting of polyethylene wax, oxidized polyethylene wax, polypropylene wax, montan wax, and amide wax.

Addition of the above-mentioned additive makes it possible to form a thick oil film on the portion which is required to be lubricated although formation of the oil film is difficult, especially when the operating speed is within a low speed region. This can prevent the direct contact between metallic members, thereby reducing the friction torque and extending the anti-flaking life. It is presumed that the mechanism of making an oil film thick, especially at a low speed region, by the specific additive is that, at a low speed region, the equivalent viscosity of the grease becomes very high, the viscosity which is comparable to the first Newtonian viscosity, while the entraining speed is low, thereby forming a thick EHL film, as explained in the above-mentioned document (Dong, Komoriya. Endo and Kimura, "Formation of EHL Film with Grease in Ball Bearings at Low Speeds", the JAST Tribologist 57-8 (2012) pp. 568-574).

The polyethylene wax and the polypropylene wax may have a weight-average molecular weight of about 1,000 to about 20,000. There are the high-density type with a density of 0.96 or more, the medium-density type with a density ranging from 0.94 to 0.95 and the low-density type with a density of 0.93 or less. The high-density type is characterized by the high melting point, softening point and crystallinity, and high degree of hardness, while the low-density type has the low melting point and softening point and exhibits the soft properties. In consideration of the heat-resistance, the dropping point of the polyethylene wax and the polypropylene wax may preferably be 100° C. or more, and more preferably 120° C. or more. From the viewpoint of the solubility in the base oil, the dropping point may preferably be 150° C. or less, and the acid value may preferably be in the range of 0 to 10 mgKOH/g, and more preferably 0 to 5 mgKOH/g. When the acid value is within the above-mentioned range, oxidative deterioration of the resultant grease by acid components can be reduced.

Specific examples of the commercially available polyethylene wax include Hi-WAX 200P, Hi-WAX 210P and Hi-WAX NL200 (made by Mitsui Chemicals, Inc.); and Licowax PE520, Licowax PE190 and Licowax PE130 (made by Clariant Japan K.K.). Specific examples of the commercially available polypropylene wax include Hi-WAX NP105 (made by Mitsui Chemicals, Inc.) and Ceridust 6050M (made by Clariant Japan K.K.) and the like.

The oxidized polyethylene wax, which is obtained by subjecting the polyethylene wax to oxidation treatment and subjecting the high-density polyethylene resin to oxidation treatment may have a weight-average molecular weight of about 3,000 to about 12,000. In consideration of the heat-resistance, the dropping point of the oxidized polyethylene wax may preferably be 90° C. or more, and more preferably 100° C. or more. From the viewpoint of the solubility in the base oil, the dropping point may preferably be 125° C. or less. The acid value may preferably be 60 mgKOH/g or less, and more preferably 30 mgKOH/g or less. When the acid value is within the above-mentioned range, oxidative deterioration of the resultant grease by acid components can advantageously be reduced.

Specific examples of the commercially available oxidized polyethylene wax include Hi-WAX 200MP, Hi-WAX 4051E and Hi-WAX 1105A (made by Mitsui Chemicals, Inc.); and Licowax PED522 (made by Clariant Japan K.K.) and the like.

The montan wax, which belongs to the group of mineral wax comprises long-chain esters as the main component, free higher alcohols, resins, sulfur-containing compounds and the like. There are acid waxes having an acid value of 110 to 160 mgKOH/g; ester waxes having both non-polar portions and polar portions; partially saponified ester waxes containing a mixture of the esterified product of montanic acid and the saponified product of the above esterified product with calcium hydroxide saponified waxes of sodium salt and calcium salt of montanic acid; ethylene oxide added montan waxes and the like. In consideration of the heat-resistance, the dropping point of the montan wax may preferably be 75° C. or more, and more preferably 80° C. or more. From the viewpoint of the solubility in the base oil, the dropping point may preferably be 105° C. or less. The acid value may preferably be in the range of 0 to 160 mgKOH/g, and more preferably 0 to 40 mgKOH/g. When the acid value is within the above-mentioned range, oxidative deterioration of the resultant grease by acid components can advantageously be reduced.

Specific examples of the commercially available montan wax include Licowax OP Flakes, Licowax S and Licolub WE40 (made by Clariant Japan K.K.) and the like.

The amide wax, which has in the molecule thereof a long-chain alkyl group and an amide group with a large polarity. There are fatty acid amides and N-substituted fatty acid amides. Examples of the fatty acid amides include lauramide, oleamide, stearamide, erucamide and the like. In consideration of the heat-resistance, the dropping point of the amide wax may preferably be 70° C. or more, and more preferably 80° C. or more. From the viewpoint of the solubility in the base oil, the dropping point may preferably be 100° C. or less.

Specific examples of the commercially available amide wax include Irmo slip CP powder, Irmo slip HT powder, Irmo slip E (made by Lion Aczo Co., Ltd.) and the like.

The dropping point herein used is the value determined in accordance with DIN51801. The acid value and the saponification value are the values obtained in accordance with DIN53402 and DIN53401, respectively.

As the essential additive as mentioned above, the polyethylene wax and the polypropylene wax are preferred, and the polyethylene wax is more preferred. In particular, the polyethylene wax with a weight-average molecular weight of 4,000 to 20,000 is desirable, and such a polyethylene wax may further preferably have an acid value of 5 mgKOH/g or less.

The content of the above-mentioned essential additive may preferably be in the range of 0.1 to 10 mass %, more preferably 0.5 to 7 mass %, and most preferably 1 to 5 mass %, based on the total mass of the grease composition of the invention.

<Other Additives>

When necessary, the grease composition of the invention may further comprise any additives. Examples are as follows: an antioxidant including amine-based and phenol-based antioxidants (e.g., amine-based antioxidants such as phenyl α-naphthylamine, alkylphenyl α-naphthylamine, alkyldiphenylamine and the like; phenol-based antioxidants including hindered phenols, such as 2,6-di-tert-butyl-p-cresol, pentaerythrityl tetrakis[3-(3,5-di-t-butyl-4-hydroxyphenyl)propionate], octadecyl-3-(3,5-di-t-butyl-4-hydroxyphenyl)propionate and the like.

An inorganic passivator such as sodium nitrite or the like.

A rust preventive such as sulfonate type, succinic acid type, amine type and carboxylate type rust preventives (e.g., organic sulfonate rust preventives such as Ca, Ba, Zn and Na salts of organic sulfonic acid and the like; succinic acid type rust preventives such as alkenylsuccinic anhydride, alkenylsuccinate, half ester of alkenylsuccinic acid and the like; amine salts of fatty acids, dibasic acids, naphthenic acids, lanolin fatty acids, alkenylsuccinic acids and the like; and carboxylate type rust preventives such as Na. K and Zn salts of aliphatic dicarboxylic acids and naphthenic acids such as sebacic acid, undecanedioic acid, dodecanedioic acid, brassilic acid, tetradecanedioic acid and the like.

A metallic corrosion inhibitor such as benzotriazole.

An oiliness improver such as fatty acids, fatty acid esters, and phosphates.

A phosphorus-containing, sulfur-containing or organic metal-containing antiwear agent or extreme-pressure agent (e.g., tricresyl phosphate, tri-2-ethylhexylphosphate; dibenzyl disulfide, a variety of polysulfides; triphenylphosphorothionate; Mo, Sb and Bi salts of dialkyldithiophosphoric acid, Mo, Zn, Sb, Ni, Cu and Bi salts of dialkyldithiocarbamic acid and the like; ash-free dithiocarbamate, ash-free dithiophosphate carbamate.

A solid lubricant including oxidized metal salts, metal salts of carbonate and molybdenum disulfide (e.g., CaO, ZnO, MgO, $CaCO_3$, $ZnCO_3$, molybdenum disulfide, graphite, PTFE, MCA and the like). Such components may be generally used in an amount of about 0.1 to 20 mass %, preferably 0.5 to 10 mass %.

<Worked Penetration>

The worked penetration of the grease composition of the invention is adjusted according to the application, and may preferably be in the range of 200 to 400. Especially when used for the rolling bearing, the grease composition of the invention may preferably have a worked penetration of 200 to 350 because there is the risk of leakage of excessively soft grease composition. When used for the constant velocity joint, the grease composition of the invention may preferably have a worked penetration of 250 to 400. When used for the ball screws, the grease composition of the invention may preferably have a worked penetration of 250 to 400.

Examples

<Preparation of Test Greases>

Grease compositions of Examples and Comparative Examples were prepared using the thickeners, base oils and additives shown in the following Tables. Specifically, diphenylmethane diisocyanate was reacted with a predetermined amine in the base oil, and the resultant mixture was heated and then cooled, followed by kneading using a three-roll mill, thereby obtaining the grease compositions of Examples and Comparative Examples.

The content of the thickener was adjusted so that the resultant grease composition might have a worked penetration of 300 (when determined in accordance with JIS K2220 7).

The grease compositions thus prepared were evaluated according to the test methods shown below. The results are also shown in the following Tables.

<Test Methods>

Measurement of EHL Film Thickness

The thickness of a grease film formed at the rolling contact portion was determined using a ultra-thin film thickness measuring instrument based on optical interference technique (EHL Ultra Thin Film Measurement System, made by PCS Instruments.) In the measurement, a steel ball with a diameter of 19.05 mm was brought into contact with a glass disc under rolling—sliding contact conditions at 25° C. under a load of 20 N. With the speed of the ball (1 m/s) being gradually decreased, the film thickness was measured when the speed of the steel ball reached the predetermined value as shown below. The term "film thickness" herein used indicates the central oil film thickness. The specific test conditions are as follows.

<Test Conditions>

Load: 20 N

Maximum contact pressure: 0.5 GPa

Speed: 0.01 m/s

Slide ratio: 5%

Temperature: 25° C.

Steel ball: with a diameter of 19.05 mm

Glass disc: coated with silica and chromium

<Decision Whether to Accept or Not>

The central thickness of oil film: 100 nm or more: o (acceptable)

less than 100 nm: x (unacceptable)

Measurement of Traction Coefficient

A two roll machine (TE54 Mini Traction friction tester, from Sanyo Trading Co., Ltd.) was used to determine the traction coefficient. The specific test conditions are as follows.

<Test Conditions>

Upper specimen: Steel ball with a diameter of 25 mm. Ra=0.01 μm

Lower specimen: Steel ring with a diameter of 50 mm, Ra=0.01 μm

Speed of upper specimen: 50 mm/s

Speed of lower specimen: 47 mm/s

Slide ratio: 5%

Temperature: 25° C.

Contact pressure: 1.5 GPa

<Decision Whether to Accept or Not>

The traction coefficient; less than 0.070: o (acceptable)

0.070 or more: x (unacceptable)

Evaluation of Anti-Flaking Properties

A rolling four-ball tester was used to evaluate the anti-flaking properties. Three steel balls with a diameter of 15 mm designed for bearings were disposed in a cylindrical container with a depth of 10.95 mm, having a bottom with an inner diameter of 36.0 mm and a top end with an inner diameter of 31.63 mm. To the steel balls, 20 g of each test grease composition was applied. Another steel ball (⅝-in) for bearing was placed in contact with the three steel balls, and driven to rotate at the predetermined number of revolutions. The lower three steel balls then revolved as each rotating on its axis. The ball was driven to rotate continuously until the flaking took place on the steel ball surfaces. The flaking occurs at a point between two balls where the highest contact pressure is applied. The life was expressed as the total revolutions counted when the flaking took place.

<Test Conditions>

Steel balls for test: a ⅝-in steel ball for bearing (driving ball) and 15-mm-dia. steel balls for bearing (driven balls)

Load for test: 400 kgf (Maximum contact pressure: 6.5 GPa)

Rotational speed: 1500 rpm

The number of repeated tests: five (average life: n=5)

<Decision Whether to Accept or Not>

The average life (total revolutions of the driving ball);

$80\times10^5$ or more: o (acceptable)

less than $80\times10^5$: x (unacceptable)

Overall Evaluation

The grease composition passed all the tests, i.e., the EHL film thickness test, the traction coefficient test and the rolling four-ball test: o (acceptable).

The grease composition failed any one of the above tests: x (unacceptable)

TABLE 1

| | | Example 1 | Example 2 | Example 3 | Example 4 | Example 5 |
|---|---|---|---|---|---|---|
| Thickener(*1) (mass % in grease composition) | Aliphatic diurea A | 10.0 | | | | |
| | Aliphatic diurea B | | 12.0 | | | |
| | Aromatic diurea | | | 21.0 | | |
| | Alicyclic•aliphatic diurea C | | | | 10.0 | |
| | Alicyclic•aliphatic diurea D | | | | | 10.0 |
| Base oil(*2) (mass % of each component based on total mass of base oil) | Synthetic hydrocarbon oil E | 100 | 100 | 100 | 100 | 100 |
| | Synthetic hydrocarbon oil F | | | | | |
| | Mineral oil G | | | | | |
| | Mineral oil H | | | | | |
| | Ester oil | | | | | |
| | Phenyl ether oil | | | | | |
| Additives(*3) (mass % in grease composition) | Polyethylene wax | 5.0 | 5.0 | 5.0 | 5.0 | 5.0 |
| | Oxidized polyethylene wax | | | | | |
| | Polypropylene wax | | | | | |
| | Montan wax | | | | | |
| | Amide wax | | | | | |
| Worked penetration | | 300 | 300 | 300 | 300 | 300 |
| Central thickness of oil film (nm) | | 300 | 290 | 360 | 300 | 310 |
| Decision whether to accept or not | | ○ | ○ | ○ | ○ | ○ |
| Traction coefficient | | 0.064 | 0.067 | 0.062 | 0.063 | 0.065 |
| Decision whether to accept or not | | ○ | ○ | ○ | ○ | ○ |

TABLE 1-continued

| | Example 1 | Example 2 | Example 3 | Example 4 | Example 5 |
|---|---|---|---|---|---|
| Average life (total revolutions of driving ball) × $10^5$ | 131 | 130 | 137 | 140 | 123 |
| Decision whether to accept or not | ○ | ○ | ○ | ○ | ○ |
| Overall evaluation | ○ | ○ | ○ | ○ | ○ |

TABLE 2

| | | Example 6 | Example 7 | Example 8 | Example 9 | Example 10 |
|---|---|---|---|---|---|---|
| Thickener(*1) (mass % in grease composition) | Aliphatic diurea A | 10.0 | 10.0 | 10.0 | 9.0 | 10.0 |
| | Aliphatic diurea B | | | | | |
| | Aromatic diurea | | | | | |
| | Alicyclic•aliphatic diurea C | | | | | |
| | Alicyclic•aliphatic diurea D | | | | | |
| Base oil(*2) (mass % of each component based on total mass of base oil) | Synthetic hydrocarbon oil E | | | | | |
| | Synthetic hydrocarbon oil F | 100 | | | | |
| | Mineral oil G | | 100 | | | |
| | Mineral oil H | | | 100 | | |
| | Ester oil | | | | 100 | |
| | Phenyl ether oil | | | | | 100 |
| Additives(*3) (mass % in grease composition) | Polyethylene wax | 5.0 | 5.0 | 5.0 | 5.0 | 5.0 |
| | Oxidized polyethylene wax | | | | | |
| | Polypropylene wax | | | | | |
| | Montan wax | | | | | |
| | Amide wax | | | | | |
| Worked penetration | | 300 | 300 | 300 | 300 | 300 |
| Central thickness of oil film (nm) | | 300 | 260 | 270 | 260 | 280 |
| Decision whether to accept or not | | ○ | ○ | ○ | ○ | ○ |
| Traction coefficient | | 0.064 | 0.068 | 0.065 | 0.067 | 0.067 |
| Decision whether to accept or not | | ○ | ○ | ○ | ○ | ○ |
| Average life (total revolutions of driving ball) × $10^5$ | | 137 | 111 | 122 | 109 | 128 |
| Decision whether to accept or not | | ○ | ○ | ○ | ○ | ○ |
| Overall evaluation | | ○ | ○ | ○ | ○ | ○ |

35

TABLE 3

| | | Example 11 | Example 12 | Example 13 | Example 14 | Example 15 |
|---|---|---|---|---|---|---|
| Thickener(*1) (mass % in grease composition) | Aliphatic diurea A | | | | | |
| | Aliphatic diurea B | | | | | |
| | Aromatic diurea | | | | | |
| | Alicyclic•aliphatic diurea C | 10.0 | 10.0 | 10.0 | 10.0 | 10.0 |
| | Alicyclic•aliphatic diurea D | | | | | |
| Base oil(*2) (mass % of each component based on total mass of base oil) | Synthetic hydrocarbon oil E | 100 | 100 | 100 | 100 | 100 |
| | Synthetic hydrocarbon oil F | | | | | |
| | Mineral oil G | | | | | |
| | Mineral oil H | | | | | |
| | Ester oil | | | | | |
| | Phenyl ether oil | | | | | |
| Additives(*3) (mass % in grease composition) | Polyethylene wax | | | | | 1.0 |
| | Oxidized polyethylene wax | 5.0 | | | | |
| | Polypropylene wax | | 5.0 | | | |
| | Montan wax | | | 5.0 | | |
| | Amide wax | | | | 5.0 | |
| Worked penetration | | 300 | 300 | 300 | 300 | 300 |
| Central thickness of oil film (nm) | | 210 | 250 | 220 | 200 | 350 |
| Decision whether to accept or not | | ○ | ○ | ○ | ○ | ○ |
| Traction coefficient | | 0.068 | 0.068 | 0.068 | 0.069 | 0.062 |
| Decision whether to accept or not | | ○ | ○ | ○ | ○ | ○ |
| Average life (total revolutions of driving ball) × $10^5$ | | 109 | 111 | 100 | 94 | 141 |
| Decision whether to accept or not | | ○ | ○ | ○ | ○ | ○ |
| Overall evaluation | | ○ | ○ | ○ | ○ | ○ |

TABLE 4

| | | Example 16 | Example 17 | Example 18 | Example 19 | Example 20 |
|---|---|---|---|---|---|---|
| Thickener(*1) (mass % in grease composition) | Aliphatic diurea A | | | | | |
| | Aliphatic diurea B | | | 12.0 | | |
| | Aromatic diurea | | 21.0 | | | |
| | Alicyclic•aliphatic diurea C | 9.0 | | | 10.5 | 9.5 |
| | Alicyclic•aliphatic diurea D | | | | | |
| Base oil(*2) (mass % of each component based on total mass of base oil) | Synthetic hydrocarbon oil E | 50 | | | 100 | 100 |
| | Synthetic hydrocarbon oil F | | 100 | | | |
| | Mineral oil G | | | 100 | | |
| | Mineral oil H | | | | | |
| | Ester oil | 50 | | | | |
| | Phenyl ether oil | | | | | |
| Additives(*3) (mass % in grease composition) | Polyethylene wax | 5.0 | 5.0 | 3.0 | 0.2 | 9.0 |
| | Oxidized polyethylene wax | | | | | |
| | Polypropylene wax | | | | | |
| | Montan wax | | | | | |
| | Amide wax | | | | | |
| Worked penetration | | 300 | 300 | 300 | 300 | 300 |
| Central thickness of oil film (nm) | | 340 | 380 | 370 | 111 | 350 |
| Decision whether to accept or not | | ○ | ○ | ○ | ○ | ○ |
| Traction coefficient | | 0.062 | 0.065 | 0.067 | 0.068 | 0.062 |
| Decision whether to accept or not | | ○ | ○ | ○ | ○ | ○ |
| Average life (total revolutions of driving ball) × $10^5$ | | 140 | 145 | 135 | 86 | 140 |
| Decision whether to accept or not | | ○ | ○ | ○ | ○ | ○ |
| Overall evaluation | | ○ | ○ | ○ | ○ | ○ |

TABLE 5

| | | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|
| Thickener(*1) (mass % in grease composition) | Aliphatic diurea A | 11.0 | | | | | 10.0 | 10.0 |
| | Aliphatic diurea B | | 13.0 | | | | | |
| | Aromatic diurea | | | 22.5 | | | | |
| | Alicyclic•aliphatic diurea C | | | | 11.0 | | | |
| | Alicyclic•aliphatic diurea D | | | | | 11.0 | | |
| Base oil(*2) (mass % of each component based on total mass of base oil) | Synthetic hydrocarbon oil E | 100 | 100 | 100 | 100 | 100 | 100 | 100 |
| | Synthetic hydrocarbon oil F | | | | | | | |
| | Mineral oil G | | | | | | | |
| | Mineral oil H | | | | | | | |
| | Ester oil | | | | | | | |
| | Phenyl ether oil | | | | | | | |
| Additives(*3) (mass % in grease composition) | Polyethylene wax | | | | | | | |
| | Oxidized polyethylene wax | | | | | | | |
| | Polypropylene wax | | | | | | | |
| | Montan wax | | | | | | | |
| | Amide wax | | | | | | | |
| | Ethylene vinyl acetate copolymer wax | | | | | | 5.0 | |
| | Zinc oxide | | | | | | | 5.0 |
| Worked penetration | | 300 | 300 | 300 | 300 | 300 | 300 | 300 |
| Central thickness of oil film (nm) | | 60 | 70 | 80 | 65 | 60 | 90 | 90 |
| Decision whether to accept or not | | x | x | x | x | x | x | x |
| Traction coefficient | | 0.080 | 0.081 | 0.085 | 0.078 | 0.080 | 0.082 | 0.084 |
| Decision whether to accept or not | | x | x | x | x | x | x | x |
| Average life (total revolutions of driving ball) × $10^5$ | | 40 | 47 | 56 | 47 | 45 | 82 | 95 |
| Decision whether to accept or not | | x | x | x | x | x | ○ | ○ |
| Overall evaluation | | x | x | x | x | x | x | x |

(*1):

Aliphatic diurea A: A reaction product of two moles of octylamine with one mole of diphenylmethane diisocyanate.

Aliphatic diurea B: A reaction product of a mixture of one mole of octylamine and one mole of octadecylamine with one mole of diphenylmethane diisocyanate.

Aromatic diurea: A reaction product of two moles of para-toluidine with one mole of diphenylmethane diisocyanate.

Alicyclic—aliphatic diurea C: A reaction product of a mixture of cyclohexylamine and octadecylamine with one mole of diphenylmethane diisocyanate, where the molar ratio of cyclohexylamine to octadecylamine is 7:1.

Alicyclic—aliphatic diurea D: A reaction product of a mixture of cyclohexylamine and octadecylamine with one mole of diphenylmethane diisocyanate, where the molar ratio of cyclohexylamine to octadecylamine is 3:7.

(*2)

Synthetic hydrocarbon oil E: A synthetic hydrocarbon oil with a kinematic viscosity at 40° C. of 30.0 $mm^2/s$.

Synthetic hydrocarbon oil F: A synthetic hydrocarbon oil with a kinematic viscosity at 40° C. of 63.3 $mm^2/s$.

Mineral oil G: A mineral oil with a kinematic viscosity at 40° C. of 100 $mm^2/s$.

Mineral oil H: A mineral oil with a kinematic viscosity at 40° C. of 135 $mm^2/s$.

Ester oil: A pentaerythritol ester oil with a kinematic viscosity at 40° C. of 30.8 $mm^2/s$.

Phenyl ether oil: A dialkyl diphenyl ether oil with a kinematic viscosity at 40° C. of 102 $mm^2$ s.

(*3)

Polyethylene Wax:

having a dropping point of 135° C., an acid value of 0 mgKOH/g, and a weight-average molecular weight of 18.000.

Oxidized Polyethylene Wax:

having a dropping point of 101° C., an acid value of 25 mgKOH/g, and a weight-average molecular weight of 3100.

Polypropylene Wax:

having a dropping point of 145° C., an acid value of 0 mgKOH/g, and a weight-average molecular weight of 3800.

Montan Wax:

having a dropping point of 99° C., an acid value of 11 mgKOH/g, and a saponification value of 112 mgKOH/g.

Amide Wax:

stearamide having a dropping point of 100° C.

Ethylene Vinyl Acetate Copolymer Wax:

having a dropping point of 102° C., an acid value of 20 mgKOH/g, and a weight-average molecular weight of 10,000.

The invention claimed is:

1. A grease composition for use in lubricating a mechanical part having a steel portion to be lubricated, the portion of which performs a rolling motion and a rolling and sliding motion, consisting of a base oil, a thickener and an additive, wherein the thickener is a diurea compound represented by formula (1):

R1-NHCONH—R2-NHCONH—R3 (1)

wherein R2 is a bivalent aromatic hydrocarbon group having 6 to 15 carbon atoms; and one of R1 or R3 represents a saturated alkyl group having 18 carbon atoms and the other represents a cyclohexyl group, the molar ratio of the cyclohexyl group to the alkyl group being 20:80 to 95:5, and wherein the additive consists of:

at least one compound selected from the group consisting of polyethylene wax having a weight-average molecular weight of 18,000 to 20,000 and a dropping point of 100 to 150° C., and 0 to 20 mass % of other additives, with respect to the total mass of the grease composition, selected from the group consisting of:

an antioxidant selected from the group consisting of phenyl a-naphthylamine, alkylphenyl a-naphthylamine, alkyldiphenylamine, 2,6-di-tert-butyl-p-cresol, pentaerythrityltetrakis[3-(3,5-di-t-butyl-4-hydroxyphenyl)propionate], and octadecyl-3-(3,5-di-t-butyl-4-hydroxyphenyl)propionate;

an inorganic passivator;

a rust preventive;

a metallic corrosion inhibitor;

an oiliness improver;

a phosphorus-containing, sulfur-containing or organic metal-containing antiwear agent or extreme-pressure agent selected from the group consisting of tricresyl phosphate, tri-2-ethylhexylphosphate; dibenzyl disulfide, polysulfide;

triphenylphosphorothionate; Mo, Sb or Bi salts of dialkyldithiophosphoric acid, Mo, Zn, Sb, Ni, Cu, or Bi salts of dialkyldithiocarbamic acid; ash-free dithiocarbamate, and ash-free dithiophosphate carbamate; and a solid lubricant selected from the group consisting of oxidized metal salts, metal salts of carbonate and molybdenum disulfide.

2. The grease composition of claim 1, wherein the at least one compound is contained in an amount of 0.1 to 10 mass % in the grease composition.

3. A mechanical part having a steel portion to be lubricated which performs a rolling motion and a rolling and sliding motion, wherein the grease composition of claim 1 is enclosed.

4. The grease composition of claim 1, wherein the base oil is selected from the group consisting of a mineral oil, a synthetic hydrocarbon oil, and an ester oil.

5. The grease composition of claim 1, wherein the base oil is a mixture of paraffinic mineral oil and naphthenic mineral oil, a synthetic hydrocarbon oil, or a mixture of a synthetic hydrocarbon oil and an ester oil.

6. The grease composition of claim 1, wherein the base oil has a kinematic viscosity at 40° C. of 10 to 200 mm2/s.

7. The grease composition of claim 1, wherein the base oil is contained in an amount of 50 to 95 mass % in the grease composition.

8. The grease composition of claim 1, wherein the thickener is contained in an amount of 3 to 30 mass % in the grease composition.

9. The grease composition of claim 1, wherein the rust preventive is contained in an amount of 0.1 to 10 mass %.

* * * * *